US010975810B2

(12) United States Patent
Lim

(10) Patent No.: US 10,975,810 B2
(45) Date of Patent: Apr. 13, 2021

(54) POSITIVE CRANKCASE VENTILATION SYSTEM

(71) Applicants: HYUNDAI MOTOR COMPANY, Seoul (KR); KIA MOTORS CORPORATION, Seoul (KR)

(72) Inventor: Jeong Kyu Lim, Suwon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/447,238

(22) Filed: Jun. 20, 2019

(65) Prior Publication Data

US 2020/0158058 A1 May 21, 2020

(30) Foreign Application Priority Data

Nov. 16, 2018 (KR) ..... 10-2018-0142022

(51) Int. Cl.

| | |
|---|---|
| ***F01M 13/04*** | (2006.01) |
| ***F02M 35/10*** | (2006.01) |
| ***F01M 13/02*** | (2006.01) |
| *F01M 13/00* | (2006.01) |

(52) U.S. Cl.

CPC .... *F02M 35/10222* (2013.01); *F01M 13/028* (2013.01); *F01M 13/04* (2013.01); *F01M 2013/0055* (2013.01)

(58) Field of Classification Search

CPC .. F01M 13/04; F01M 13/023; F01M 13/0416; F01M 11/08

See application file for complete search history.

(56) References Cited

U.S. PATENT DOCUMENTS

| | | | | |
|---|---|---|---|---|
| 4,528,969 | A * | 7/1985 | Senga | F01M 13/04 123/572 |
| 4,693,226 | A * | 9/1987 | Choma | F02M 35/10085 123/568.17 |
| 5,307,784 | A * | 5/1994 | Choma | F02M 26/50 123/568.17 |
| 5,490,488 | A * | 2/1996 | Aversa | F02B 75/22 123/184.31 |
| 2004/0159314 | A1* | 8/2004 | Ishizuka | F01M 13/0416 123/572 |
| 2011/0139098 | A1* | 6/2011 | Nelander | F02M 35/10222 123/41.86 |
| 2013/0112159 | A1* | 5/2013 | Lohr | F01M 13/0405 123/41.86 |

(Continued)

FOREIGN PATENT DOCUMENTS

KR 20020046519 A * 6/2002

*Primary Examiner* — George C Jin
*Assistant Examiner* — Teuta B Holbrook
(74) *Attorney, Agent, or Firm* — Lempia Summerfield Katz LLC

(57) ABSTRACT

A positive crankcase ventilation (PCV) system includes: an oil separator separating oil from blow-by gases; a PCV valve allowing the blow-by gases from which the oil has been separated by the oil separator to flow into intake ports of a cylinder head; a PCV passage vertically extending from the PCV valve; a PCV chamber connected to the PCV passage; and a plurality of bypass passages branching off from the PCV chamber to the intake ports, respectively.

6 Claims, 7 Drawing Sheets

(56) References Cited

U.S. PATENT DOCUMENTS

| | | | | |
|---|---|---|---|---|
| 2016/0047283 | A1* | 2/2016 | Newman | F01M 13/023<br>123/574 |
| 2016/0237962 | A1* | 8/2016 | Iwazume | F02M 35/10255 |
| 2016/0265404 | A1* | 9/2016 | Fujii | F01M 13/04 |
| 2019/0017420 | A1* | 1/2019 | Kashiwabara | F01M 13/0416 |
| 2020/0102863 | A1* | 4/2020 | Ishikawa | F01M 13/04 |

* cited by examiner

POSITIVE CRANKCASE VENTILATION SYSTEM

CROSS-REFERENCE TO RELATED APPLICATION

This application is based on and claims the benefit of priority to Korean Patent Application No. 10-2018-0142022, filed on Nov. 16, 2018, in the Korean Intellectual Property Office, the disclosure of which is incorporated herein in its entirety by reference.

TECHNICAL FIELD

The present disclosure relates to a positive crankcase ventilation (PCV) system, and more particularly, to a PCV system capable of directly delivering blow-by gases to an intake port of each cylinder of an engine, thereby preventing freezing of the blow-by gases and uniformly distributing the blow-by gases.

BACKGROUND

An internal combustion engine is a device that produces power by burning air and fuel. When the internal combustion engine is operated, blow-by gases are generated in the compression stroke and the expansion stroke. Blow-by gases are combustion gases, which flow into a crankcase through gaps between piston rings and the wall of a combustion chamber by the force of the high-pressure gases produced in the combustion process.

When the blow-by gases are introduced into the crankcase, pressure increases in the crankcase, and the high-temperature blow-by gases may deteriorate or oxidize the engine oil contained in an oil pan of the crankcase. Thus, it is necessary to discharge the blow-by gases introduced into the crankcase. A positive crankcase ventilation (PCV) system may be configured to recirculate the blow-by gases in the crankcase to an intake system of the internal combustion engine.

The PCV system may include an oil separator disposed on the cylinder head side and a PCV valve allowing the blow-by gases from which oil has been separated by the oil separator to flow into the intake system of the internal combustion engine. The oil separator may be configured to separate the oil from the blow-by gases collected from the crankcase through a collection passage. After the engine is started, the PCV valve is opened by negative pressure generated on the intake system side The opening of the PCV valve allows the blow-by gases to flow into the intake system of the internal combustion engine.

Meanwhile, a conventional PCV system includes a PCV hose connecting between a PCV valve and an intake manifold of the internal combustion engine The blow-by gases flow into the intake manifold of the internal combustion engine through the PCV hose.

In the conventional PCV system, since the PCV hose is exposed to the outside of the internal combustion engine, freezing has frequently occurred in the PCV hose due to vehicle-induced wind (driving wind) while the vehicle is driving in the winter, resulting in abnormal combustion of the internal combustion engine. As for the blow-by gases introduced into the intake manifold, the flow rates of blow-by gases flowing into respective cylinders are different due to a length difference between runners of the intake manifold. In addition, an assembly process of the PCV hose is very troublesome, which reduces the assembly quality.

In order to solve the aforementioned problems, a unitary one-piece structure in which a blow-by gas passage is integrally formed inside the intake manifold has recently been proposed. Because such a unitary one-piece structure is formed by embedding the blow-by gas passage in the intake manifold, it may partially prevent freezing. However, since the intake manifold is located in the foremost position of an engine compartment, freezing caused by the wind blowing into the engine compartment may not be completely prevented. In some very cold regions, freezing problems may still occur.

According to the related art, since the blow-by gas passage is determined in accordance with the shape of the intake manifold, the blow-by gases may not uniformly flow into multiple runners, resulting in different flow rates of the blow-by gases flowing into respective cylinders.

Meanwhile, the oil separator separates the oil from the blow-by gases introduced from the crankcase into the cylinder head However, it is practically impossible for the oil separator to completely separate the oil from the blow-by gases. That is, even though the blow-by gases pass through the oil separator, a small amount of oil is still contained in the blow-by gases.

As such, the blow-by gases from which the oil has been separated by the oil separator still contain a small amount of oil. If the blow-by gases are not uniformly distributed to the respective cylinders of the internal combustion engine and instead are intensively or excessively introduced into one cylinder, there is a high possibility that abnormal combustion occurs in the corresponding cylinder. Thus, the PCV system needs to uniformly distribute the blow-by gases to the cylinders to prevent the abnormal combustion.

The above information described in this background section is provided to assist in understanding the background of the inventive concept This background section may thus include any technical concept which is not considered as the prior art that is already known to those of ordinary skill in the art.

SUMMARY

The present disclosure has been made to solve the above-mentioned problems occurring in the prior art while advantages achieved by the prior art are maintained intact.

An aspect of the present disclosure provides a positive crankcase ventilation (PCV) system having a PCV passage on the cylinder head side of an internal combustion engine to thereby prevent freezing of blow-by gases. The PCV system allows the blow-by gases to be directly delivered to an intake port of each cylinder without passing through an intake manifold, thereby uniformly distributing the blow-by gases to multiple cylinders.

According to an aspect of the present disclosure, a PCV system may include: an oil separator separating oil from blow-by gases; a PCV valve allowing the blow-by gases from which the oil has been separated by the oil separator to flow into intake ports of a cylinder head; a PCV passage vertically extending from the PCV valve; a PCV chamber connected to the PCV passage; and a plurality of bypass passages branching off from the PCV chamber to the intake ports, respectively.

The PCV chamber may extend horizontally above the intake ports.

A cam carrier may be coupled to an upper surface of the cylinder head, and a head cover may be coupled to an upper surface of the cam carrier. The oil separator and the PCV valve may be mounted in the head cover and the PCV passage may extend from the head cover to the cylinder head.

The PCV passage may include a first passage formed in the head cover and a second passage formed in the cam carrier.

A diameter of the first passage may be larger than a diameter of the second passage.

The bypass passages may extend vertically from the PCV chamber to the intake ports, respectively.

The bypass passages may have the same length.

The PCV chamber may be formed in an edge portion of an upper surface of an outer wall of the cylinder head.

The PCV chamber may be formed in the cam carrier.

BRIEF DESCRIPTION OF THE DRAWINGS

The above and other objects, features, and advantages of the present disclosure will be more apparent from the following detailed description taken in conjunction with the accompanying drawings.

DETAILED DESCRIPTION

Figure 1:
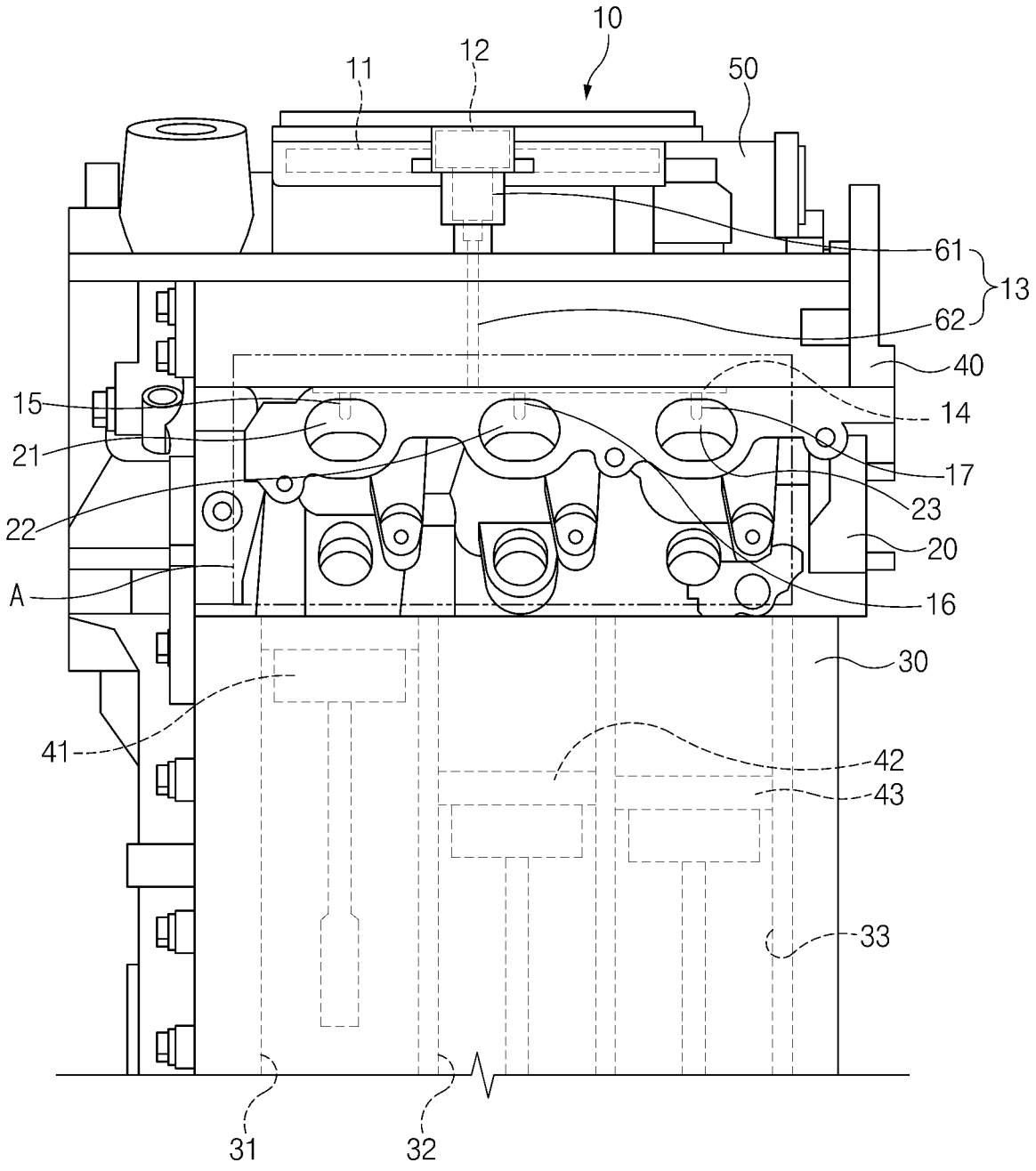
FIG. 1 illustrates a positive crankcase ventilation (PCV) system according to an embodiment of the present disclosure.
Figure 2:
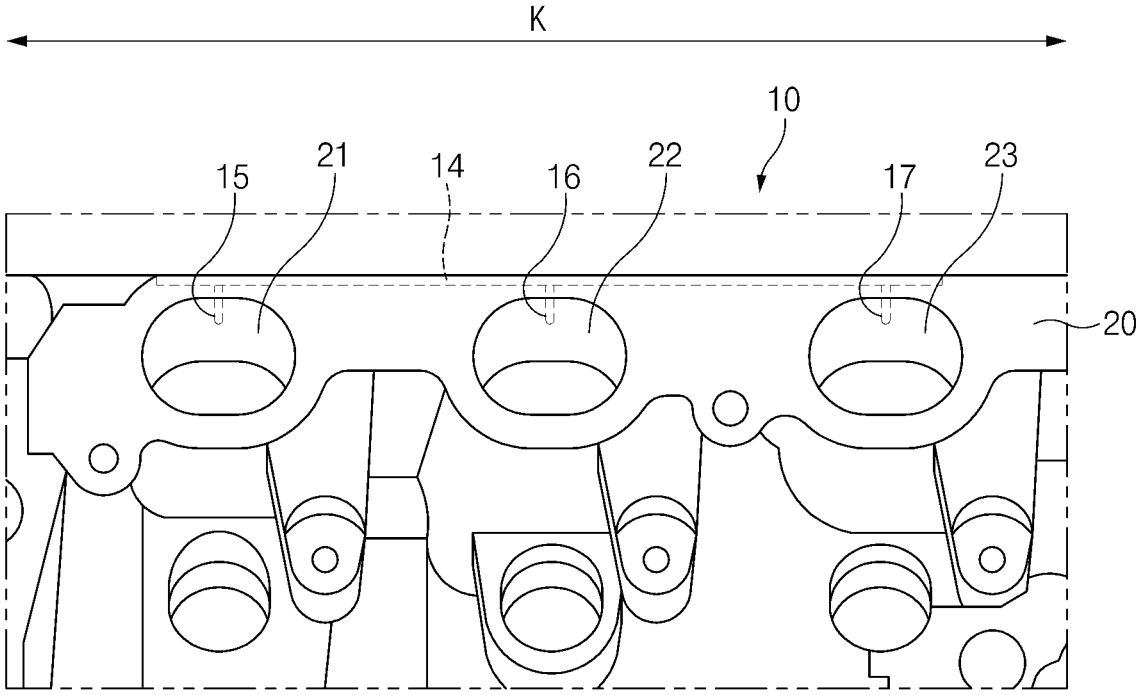
FIG. 2 illustrates an enlarged view of portion A in FIG. 1.

Hereinafter, embodiments of the present disclosure are described in detail with reference to the accompanying drawings. In the drawings, the same reference numerals are used throughout to designate the same or equivalent elements. In addition, a detailed description of well-known techniques associated with the present disclosure have been excluded in order not to unnecessarily obscure the gist of the present disclosure.

Terms such as first, second, A, B, (a), and (b) may be used to describe the elements in embodiments of the present disclosure. These terms are only used to distinguish one element from another element. The intrinsic features, sequence or order, and the like of the corresponding elements are not limited by the terms. Unless otherwise defined, all terms used herein, including technical or scientific terms, have the same meanings as those generally understood by those with ordinary knowledge in the field of art to which the present disclosure belongs. Such terms as those defined in a generally used dictionary are to be interpreted as having meanings equal to the contextual meanings in the relevant field of art and are not to be interpreted as having ideal or excessively formal meanings unless clearly defined as having such in the present application.

Referring to FIGS. 1-5, a positive crankcase ventilation (PCV) system 10 according to an embodiment of the present disclosure may include a cylinder head 20, an oil separator 11 disposed on the cylinder head 20, a PCV valve 12 allowing blow-by gases from which oil has been separated by the oil separator 11 to flow into intake ports 21, 22, and 23 of the cylinder head 20, a PCV passage 13 vertically extending from the PCV valve 12, a PCV chamber 14 connected to the PCV passage 13, and a plurality of bypass passages 15, 16, and 17 branching off from the PCV chamber 14 to the intake ports 21, 22, and 23, respectively.

The cylinder head 20 may be combined with a cylinder block 30 and the cylinder block 30 may include a plurality of cylinders 31, 32, and 33. The cylinders 31, 32, and 33 may have pistons 41, 42, and 43 reciprocating upwardly and downwardly, respectively. The cylinder head 20 may have the plurality of intake ports 21, 22, and 23 corresponding to the cylinders 31, 32, and 33, respectively.

According to an embodiment, a cam carrier 40 supporting a cam shaft (not shown) may be coupled to an upper surface of the cylinder head 20. A head cover 50 may be coupled to an upper surface of the cam carrier 40.

According to an embodiment, the oil separator 11 may be mounted within the head cover 50. The oil separator 11 may separate the oil from the blow-by gases collected from a crankcase (not shown) through a collection passage. The blow-by gases from which the oil has been separated by the oil separator 11 may still contain a small amount of oil.

The PCV valve 12 may be mounted on a top end of the head cover 50. As a negative pressure is generated in an intake manifold or the intake ports 21, 22, and 23 immediately after an engine is started, the PCV valve 12 may be opened. As the PCV valve 12 is opened, the blow-by gases may be discharged from the oil separator 11 to the PCV passage 13.

The PCV passage 13 may be connected to an outlet of the PCV valve 12. The opening of the PCV valve 12 may allow the blow-by gases to flow to the PCV passage 13.

The PCV passage 13 may extend from the head cover 50 to the cylinder head 20. The PCV passage 13 may extend straightly, i.e., may be linear in a vertical direction. Thus, the blow-by gases in which the oil is contained may flow down through the PCV passage 13 by gravity.

The PCV passage 13 may include a first passage 61 formed in an outer wall of the head cover 50 and a second passage 62 formed in an outer wall of the cam carrier 40. The second passage 62 may be continuously connected to the lower portion of the first passage 61.

According to an embodiment, a diameter of the first passage 61 may be larger than a diameter of the second passage 62. Thus, the blow-by gases may be discharged from the outlet of the PCV valve 12 more quickly.

The PCV chamber 14 may be connected to a bottom end of the PCV passage 13. The PCV chamber 14 may be located above the plurality of intake ports 21, 22, and 23 and the PCV chamber 14 may extend in a direction in which the plurality of intake ports 21, 22, and 23 are arranged (the direction of arrow K in FIG. 2). As the PCV chamber 14 extends horizontally, the PCV chamber 14 may be orthogonal to the PCV passage 13 and the blow-by gases from the PCV passage 13 may be uniformly received in the PCV chamber 14.

The plurality of bypass passages 15, 16, and 17 may branch off from the PCV chamber 14 to the intake ports 21, 22, and 23, respectively. The bypass passages 15, 16, and 17 may extend vertically from the PCV chamber 14 to the intake ports 21, 22, and 23, respectively. In such a structure in which each of the bypass passages 15, 16, and 17 extends vertically, the blow-by gases always move downward in a gravity direction regardless of the structure of runners of the intake manifold. Thus, stagnation or backflow of the blow-by gases may not occur and a constant injection amount of blow-by gases may be supplied to each of the intake ports 21, 22, and 23.

According to an embodiment, the bypass passages 15, 16, and 17 may have the same length. Thus, the blow-by gases may be uniformly distributed from the PCV chamber 14 to the intake ports 21, 22, and 23.

After the blow-by gases are received in the PCV chamber 14, the blow-by gases may be directly supplied from the PCV chamber 14 to the intake ports 21, 22, and 23 through the bypass passages 15, 16, and 17, respectively. Since the blow-by gases are uniformly distributed to the plurality of intake ports 21, 22, and 23, the blow-by gases may be prevented from being excessively introduced into any one of the cylinders.

During the intake stroke of any one cylinder 31, 32, or 33, when an intake valve is opened and the corresponding piston 41, 42, or 43 moves downward, the blow-by gases may be introduced from the PCV chamber 14 into the corresponding intake port 21, 22, or 23 through the corresponding bypass passage 15, 16, or 17.

In one embodiment of the present disclosure, the PCV chamber 14 may be formed in an edge portion of an upper surface of an outer wall 25 of the cylinder head 20. Sealing between the cylinder head 20 and the cam carrier 40 may be sufficiently secured.

Figure 5:
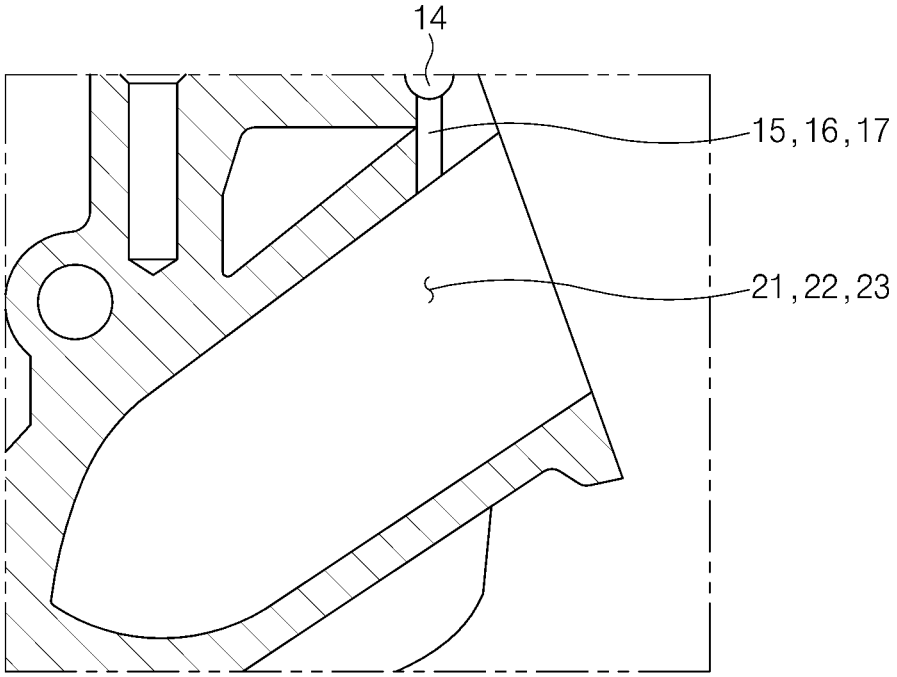
FIG. 5 illustrates a cross-sectional view taken along line C-C in FIG. 4.

According to an embodiment illustrated in FIG. 5, the PCV chamber 14 may be formed to have a semicircular cross-section so that the blow-by gases may be contained in the PCV chamber 14.

Figure 6:
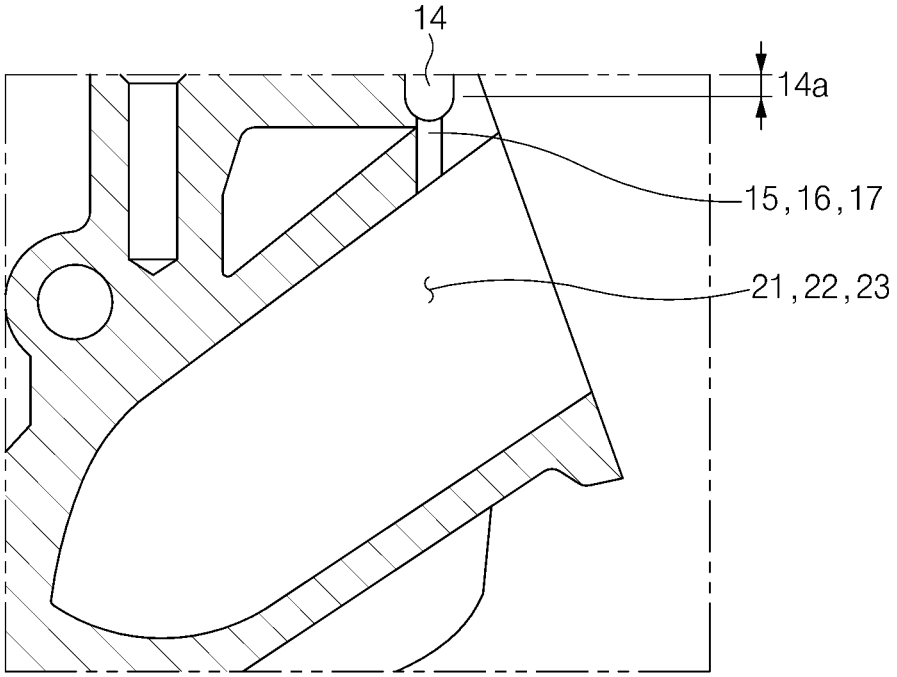
FIG. 6 illustrates a modification to the embodiment of FIG. 5.

According to an embodiment illustrated in FIG. 6, the PCV chamber 14 may further have a clearance space 14*a*, which is formed to be flat to a predetermined depth. The overall volume of the PCV chamber 14 may be increased by the clearance space 14*a*.

In order for the blow-by gases containing the oil to flow into each of the intake ports 21, 22, and 23 by the negative pressure of each of the intake ports 21, 22, and 23, a diameter of each of the bypass passages 15, 16, and 17 may be smaller than a diameter of an oil droplet to be formed by surface tension. In other words, the diameter of each of the bypass passages 15, 16, and 17 may be determined to be smaller than the diameter of the oil droplet to be formed by surface tension so as to prevent the oil contained in the blow-by gases from flowing down by free falling to the intake ports 21, 22, and 23 through the bypass passages 15, 16, and 17.

Figure 3:
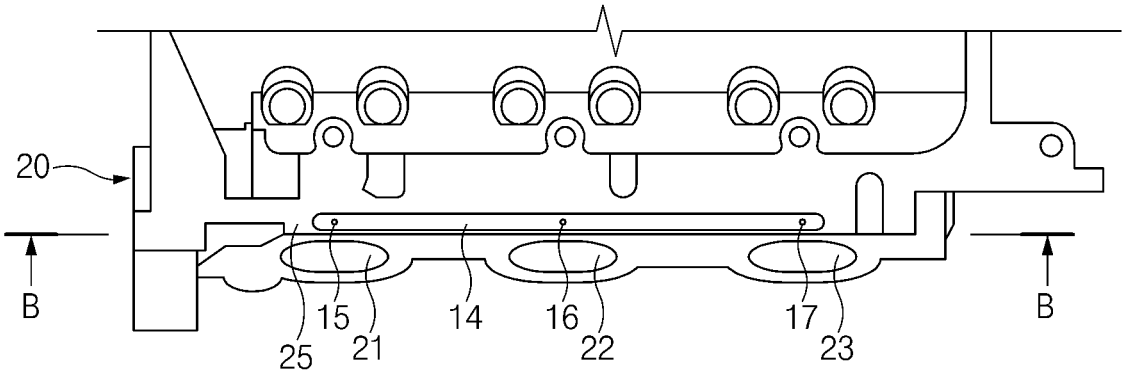
FIG. 3 illustrates a plan view of a PCV chamber in a PCV system according to an embodiment of the present disclosure.
Figure 4:
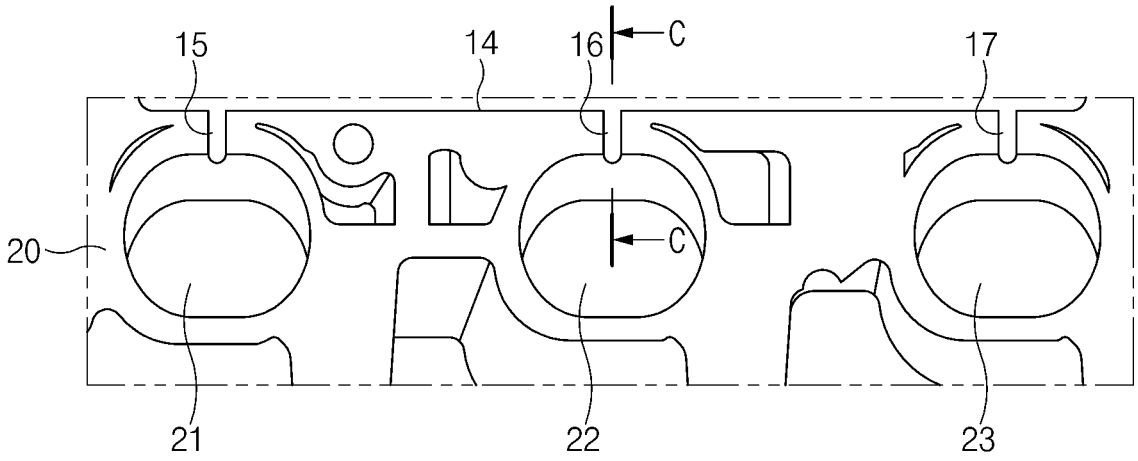
FIG. 4 illustrates a cross-sectional view taken along line B-B in FIG. 3.

Referring to FIGS. 3-5, the PCV chamber 14 may be formed in the cylinder head 20. In particular, the PCV chamber 14 may be formed in the edge portion of the upper surface of the outer wall 25 of the cylinder head 20. In one embodiment of the present disclosure, the PCV passage 13, the PCV chamber 14, and the bypass passages 15, 16, and 17 may be formed as an integral part in the cylinder head 20, the cam carrier 40, and the head cover 50. Since the PCV passage 13, the PCV chamber 14, and the bypass passages 15, 16, and 17 are not exposed to the outside, freezing may be reliably prevented.

Figure 7:
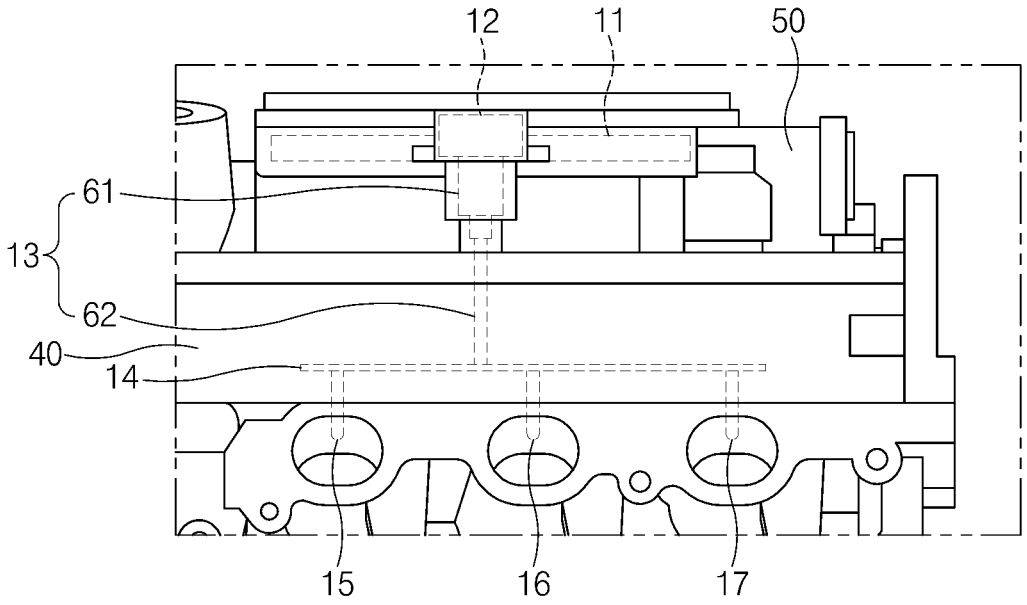
FIG. 7 illustrates a PCV system according to another embodiment of the present disclosure.

According to an embodiment illustrated in FIG. 7, the PCV chamber 14 may be formed in the cam carrier 40 located on the cylinder head 20 to extend horizontally. Sealing between the cylinder head 20 and the cam carrier 40 may be ensured.

As set forth above, according to embodiments of the present disclosure, the PCV passage may be formed on the cylinder head side of the internal combustion engine so that freezing of blow-by gases may be prevented. The blow-by gases may be directly delivered to the intake port of each cylinder so that the blow-by gases may be uniformly distributed to the plurality of cylinders.

In addition, according to embodiments of the present disclosure, regardless of any structure of the runners of the intake manifold, the PCV passage may be formed in the downward gravity direction so as to prevent stagnation or backflow of blow-by gases and to maintain a constant injection amount of blow-by gases.

According to embodiments of the present disclosure, a structure is provided in which a coolant for engine cooling continuously circulates in a water jacket of the cylinder head. The coolant containing antifreeze does not freeze even at extremely low temperatures. The coolant always keeps a temperature above zero after warm-up is completed, thus helping keep the temperatures of peripheral components above a certain level. Meanwhile, since the cylinder head is not located in the foremost position of the engine, it may not be directly hit by vehicle-induced wind (wind induced by driving the vehicle). Even if the surrounding ambient temperature and atmosphere temperature drop below zero, the antifreeze may allow continuous warm-up.

In addition, the present inventive concept may fundamentally prevent the mechanism of freezing due to the warm-up using the coolant of the cylinder head and due to a change in position of the PCV passage in a manner that allows the PCV passage to be indirectly hit by the wind so as not to be directly hit by the wind.

Hereinabove, although the present disclosure has been described with reference to embodiments and the accompanying drawings, the present disclosure is not limited thereto, but may be variously modified and altered by those of ordinary skill in the art to which the present disclosure pertains without departing from the spirit and scope of the present disclosure claimed in the following claims.

What is claimed is:

1. A positive crankcase ventilation (PCV) system, comprising:

an oil separator separating oil from blow-by gases;

a PCV valve allowing the blow-by gases from which the oil has been separated by the oil separator to flow into intake ports of a cylinder head;

a PCV passage vertically extending from the PCV valve;

a PCV chamber connected to the PCV passage; and a plurality of bypass passages branching off from the PCV chamber to the intake ports, respectively, wherein the PCV chamber extends horizontally above the intake ports, wherein the PCV passage extends straightly to be orthogonal to the PCV chamber, and wherein the PCV passage includes a first passage formed in the head cover and a second passage formed in the cam carrier, the first passage extending straightly, the second passage extending straightly, and a diameter of the first passage being larger than a diameter of the second passage.

2. The PCV system according to claim 1, wherein a cam carrier is coupled to an upper surface of the cylinder head, a head cover is coupled to an upper surface of the cam carrier, the oil separator and the PCV valve are mounted in the head cover, and the PCV passage extends from the head cover to the cylinder head.

3. The PCV system according to claim 2, wherein the PCV chamber is formed in an edge portion of an upper surface of an outer wall of the cylinder head.

4. The PCV system according to claim 2, wherein the PCV chamber is formed in the cam carrier.

5. The PCV system according to claim 1, wherein the plurality of bypass passages extend vertically from the PCV chamber to the intake ports, respectively.

6. The PCV system according to claim 1, wherein the plurality of bypass passages have the same length.

* * * * *